US005866863A

United States Patent [19]

Cole

[11] Patent Number: 5,866,863

[45] Date of Patent: Feb. 2, 1999

[54] APPARATUS FOR PERMITTING QUIET MANUAL SETTING OF AN APPLIANCE TIMER

[75] Inventor: Ronald E. Cole, Johnson County, Ind.

[73] Assignee: Emerson Electric Co., St. Louis, Mo.

[21] Appl. No.: 866,394

[22] Filed: May 30, 1997

Related U.S. Application Data

[63] Continuation-in-part of Ser. No. 771,561, Dec. 20, 1996.

[51] Int. Cl.[6] ..... H01H 7/08

[52] U.S. Cl. ..... 200/38 R; 200/38 B

[58] Field of Search ..... 200/33 R, 35 R, 200/36, 37 R, 37 A, 38 R–38 DC, 35 H, 33 B

[56] References Cited

U.S. PATENT DOCUMENTS

| | | | |
|---|---|---|---|
| 4,103,119 | 7/1978 | Homan et al. | 200/35 R |
| 4,413,164 | 11/1983 | Obermann et al. | 200/38 R |
| 4,755,635 | 7/1988 | Willingman | 200/35 R |
| 4,983,790 | 1/1991 | Bogda et al. | 200/30 R |
| 5,030,801 | 7/1991 | Amonett | 200/38 R |
| 5,170,022 | 12/1992 | Bouron | 200/38 R |
| 5,290,978 | 3/1994 | Georgacakis et al. | 200/38 R |
| 5,400,302 | 3/1995 | Yamamoto et al. | 368/107 |
| 5,510,585 | 4/1996 | Duve et al. | 200/35 R |
| 5,652,418 | 7/1997 | Amonett | 200/38 B |
| 5,689,096 | 11/1997 | Weaver et al. | 200/38 R |

*Primary Examiner*—Michael A. Friedhofer

*Attorney, Agent, or Firm*—Mark D. Becker

[57] ABSTRACT

An apparatus for permitting quiet manual setting of an appliance timer is disclosed. The apparatus has an appliance control cam which has a first cam surface defined on a first side thereof and a second cam surface defined on a second side thereof. The apparatus includes a rocker arm positionable between a first cam reading mode of operation and a first idle mode of operation. The rocker arm contacts the first cam surface when the rocker arm is positioned in the first cam reading mode of operation. The rocker arm is spaced apart from the first cam surface when the rocker arm is positioned in the first idle mode of operation. The apparatus also includes a cam follower arm positionable between a second cam reading mode of operation and a second idle mode of operation. The cam follower arm contacts the second cam surface when the cam follower arm is positioned in the second cam reading mode of operation. The cam follower arm is spaced apart from the second cam surface when the cam follower arm is positioned in the second idle mode of operation. The apparatus further includes a control shaft positionable between a first position and a second position. The apparatus also includes an intermediate member. The control shaft locates the intermediate member so as to cause the intermediate member to position (1) the rocker arm in the first idle mode of operation, and the cam follower arm in the second idle mode of operation when the control shaft is positioned in the first position, and (2) the rocker arm in the first cam reading mode of operation, and the cam follower arm in the second cam reading mode of operation when the control shaft is positioned in the second position.

20 Claims, 11 Drawing Sheets

| | | | |
|---|---|---|---|
| RING GEAR 58, 60 | $N_S/N_R$ X RPM | ZERO BRAKE | FREE SPIN |
| PLANETARY GEARS 50, 52 | $N_S/N_P$ X RPM | * | FREE SPIN |
| OUTPUT GEAR 30, 46 | ZERO | $\frac{N_S}{N_R+N_S}$ X | FREE SPIN |
| SUN GEAR 28a, 44a | X RPM | X RPM | ZERO (OFF) |

$* \left(\frac{N_R}{N_P}\right)\left(\frac{N_S}{N_R}+N_S\right) X$ RPM

APPARATUS FOR PERMITTING QUIET MANUAL SETTING OF AN APPLIANCE TIMER

This application is a continuation-in-part of copending U.S. patent application Ser. No. 08/771,561, filed Dec. 20, 1996, entitled "Appliance Timer Having a Cam Which is Operated at Multiple Speeds" by Ronald E. Cole.

BACKGROUND OF THE INVENTION

The present invention relates generally to timing devices, and more specifically to an appliance timer having an apparatus for permitting quiet manual setting of the appliance timer.

Appliance timers are commonly used in many household appliances, such as dishwashers, clothes washers, and clothes dryers. The appliance timer controls operations of the appliance by actuating and deactuating switches which start and stop various work operations within the appliance such as a rinse operation in the case of a dishwasher. The switches within the appliance timer are actuated and deactuated by interaction of a cam surface defined in a cam of the appliance timer and a cam follower which is associated with a particular switch.

One common appliance timer is an interval drive timer. This type of appliance timer typically includes a number of vertically mounted cylindrical cams driven by a ratchet and drive pawl assembly. Each of the cams includes a cam profile defined in an outer surface thereof which selectively actuates one or more switches thereby controlling various work operations of the appliance. In operation, the drive pawl indexes the ratchet at predetermined intervals. Accordingly, the ratchet, and thus the cams attached thereto, are in motion for a first period of time. Thereafter, the ratchet is at rest for a second period of time until the next movement thereof by the drive pawl. For example, a one-minute interval timer may cause the ratchet to be in motion for five seconds and then at rest for 55 seconds.

It is desirable to control an entire cycle of the appliance with one 360° rotation of the cam of the appliance timer. This feature enables the appliance timer to possess a reduced number of parts since only one cam would be necessary in the timer. In addition, this feature enables manual setting of the appliance timer to be simplified. This is true since any operational segment of the appliance cycle may be accessed by manually rotating a setting knob, which is operatively coupled to the cam, a rotational distance of less than 360°.

However, by controlling the entire cycle of the appliance with one 360° rotation of the cam, the amount of cam surface which is available for actuating and deactuating switches within the appliance timer is limited. This becomes a problem since it is desirable to quickly rotate the cam so as to increase the accuracy of the timer. More specifically, the timer's ability to control timing accuracy of the duration of a work operation between the point in time at which the work operation begins and the point in time at which the work operation ends is directly proportional to rotational speed of the cam. This is true since dimensional errors (e.g. manufacturing errors) and design tolerances associated with the components of the timer (e.g. the cam profiles and the cam followers) remain constant regardless of rotational speed of the cam. For example, if the location of a drop along the cam profile associated with actuation of a particular work operation is placed 2° further down the cam profile by a manufacturing error, the cam follower will be required to travel the additional 2° prior to dropping, therefore delaying the actuation of the work operation. If the cam is rotating at a speed of 0.5° per second, actuation of the work operation will be delayed by four seconds. However, if the cam is rotating at a speed of 4° per second, actuation of the work operation will be delayed by only one-half second thereby improving the accuracy of the timer.

Thus, in the operation of an appliance timer, it should be appreciated that there exists a tension between the desire to quickly rotate a cam of an appliance timer so as to improve the accuracy of the timer, and the desire to slowly rotate the cam of the appliance timer so that the entire cycle of the appliance is controlled by one 360° rotation of the cam.

Moreover, it is also desirable to provide an appliance timer which may be manually set by the operator in a quiet manner. More specifically, it is desirable to provide an appliance timer in which noise generating components (e.g. a number of cam followers and their associated cam profiles) are disengaged from one another during a period of time in which the operator manually sets the appliance timer. This disengagement of noise generating components reduces the noise associated with the appliance timer.

What is needed therefore is an appliance timer which rotates a cam at a high speed when actuating or deactuating switches within the appliance timer so as to more accurately control critical work operations, yet rotates the cam at a low speed when the appliance timer is actuating or deactuating switches of work operations which are not critical so that space on the surface of the cam is conserved. What is further needed is an appliance timer which has an apparatus for permitting quiet manual setting of the appliance timer.

SUMMARY OF THE INVENTION

In accordance with a first embodiment of the present invention, there is provided an apparatus for permitting quiet manual setting of an appliance timer. The appliance timer includes an appliance control cam having a cam surface defined therein. The apparatus includes a cam reading arm positionable between a cam reading mode of operation and an idle mode of operation. The cam reading arm contacts the cam surface when the cam reading arm is positioned in the cam reading mode of operation. The cam reading arm is spaced apart from the cam surface when the cam reading arm is positioned in the idle mode of operation. The apparatus also includes a control shaft positionable between a first position and a second position. The apparatus further includes an intermediate member. The control shaft locates the intermediate member so as to cause the intermediate member to position the cam reading arm in the idle mode of operation when the control shaft is positioned in the first position. The control shaft locates the intermediate member so as to cause the intermediate member to position the cam reading arm in the cam reading mode of operation when the control shaft is positioned in the second position.

In accordance with a second embodiment of the present invention, there is provided an apparatus for permitting quiet manual setting of an appliance timer. The appliance timer includes an appliance control cam having a first cam surface defined on a first side thereof and a second cam surface defined on a second side thereof. The apparatus includes a arm positionable between a first cam reading mode of operation and a first idle mode of operation. The rocker arm contacts the first cam surface when the rocker arm is positioned in the first cam reading mode of operation. The rocker arm is spaced apart from the first cam surface when the rocker arm is positioned in the first idle mode of operation. The apparatus also includes a cam follower arm positionable between a second cam reading mode of operation and a second idle mode of operation. The cam follower arm contacts the second cam surface when the cam follower arm is positioned in the second cam reading mode of operation. The cam follower arm is spaced apart from the second cam surface when the cam follower arm is positioned in the second idle mode of operation. The apparatus further includes a control shaft positionable between a first position and a second position. The apparatus also includes an intermediate member. The control shaft locates the intermediate member so as to cause the intermediate member to position (1) the rocker arm in the first idle mode of operation, and the cam follower arm in the second idle mode of operation when the control shaft is positioned in the first position, and (2) the rocker arm in the first cam reading mode of operation, and the cam follower arm in the second cam reading mode of operation when the control shaft is positioned in the second position.

It is therefore an object of the present invention to provide a new and useful appliance timer.

It is another object of the present invention to provide an improved appliance timer.

It is a further object of the present invention to provide a new and useful method of operating an appliance timer.

It is moreover an object of the present invention to provide an improved method of operating an appliance timer.

It is yet another object of the present invention to provide an appliance timer which rotates a cam at a high speed when actuating or deactuating switches associated with critical appliance work operations, and rotates the cam at a low speed when (1) actuating or deactuating switches associated with non-critical work operations or (2) conserving cam space without actuating or deactuating switches.

It is further another object of the present invention to provide an appliance timer which achieves high timing accuracy of the various work operations within the appliance timer, yet controls the entire cycle of the appliance with one 360° rotation of a single cam.

It is yet another object of the present invention to provide an appliance timer which has an apparatus for permitting quiet manual setting of the appliance timer.

The above and other objects, features, and advantages of the present invention will become apparent from the follower description and the attached drawings.

DETAILED DESCRIPTION OF THE INVENTION

Figure 1:
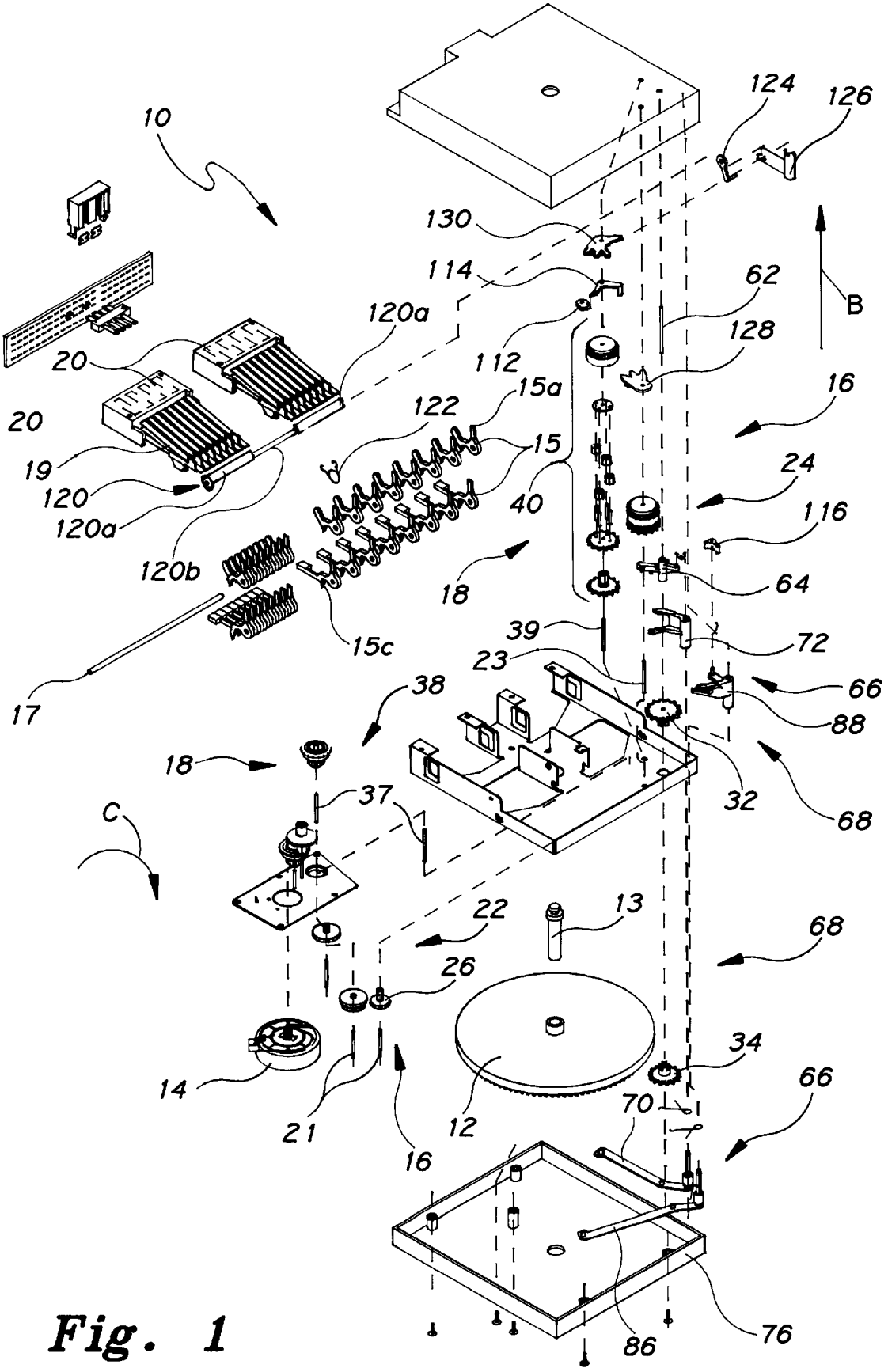
FIG. 1 is an exploded perspective view of an appliance timer which incorporates the features of the present invention therein.

While the invention is susceptible to various modifications and alternative forms, a specific embodiment thereof has been shown by way of example in the drawings and will herein be described in detail. It should be understood, however, that there is no intent to limit the invention to the particular form disclosed, but on the contrary, the intention is to cover all modifications, equivalents, and alternatives falling within the spirit and scope of the invention as defined by the appended claims.

Referring now to FIGS. 1–4, there is shown an appliance timer 10 which controls a number of work operations within an appliance such as a rinse operation of a dishwasher. The appliance timer 10 includes an appliance control cam 12, a motor 14, a high-speed gear assembly 16, a low-speed gear assembly 18, and a group of output terminals 20.

The cam 12 is a flat, horizontally disposed cam of a type commonly referred to in the art as a "pancake" cam. Moreover, the cam 12 is secured to a control shaft 13. One manner of securing the cam 12 to the control shaft 13 is with a clutch mechanism (not shown).

The appliance timer 10 further includes a number of cam reading or rocker arms 15 rotatably secured to a rocker arm shaft 17. Each of the rocker arms 15 include a follower member 15*c* which cooperates in a known manner with a number of cam profiles 25 (see FIG. 3) defined in a top side of the cam 12. As each of the rocker arms 15 is selectively moved by a respective cam profile, one of a number of switches 19 is actuated thereby generating an output signal on a respective output terminal 20 so as to electrically couple a device such as an electrically-actuated water valve (not shown) included in the appliance to a power source thereby controlling a particular work operation within the appliance.

The high-speed gear assembly 16 includes a high-speed gear train 22 and a high-speed planetary gear set 24. The high-speed gear train 22 is rotatably disposed on a pair of posts 21, whereas the high-speed planetary gear set is rotatably disposed on a post 23. An output gear 26 of the high-speed gear train 22 meshingly engages an input gear 28 (see FIG. 2) of the high-speed planetary gear set 24. An output gear 30 (see FIG. 2) of the high-speed planetary gear set 24 meshingly engages a transfer gear 32. The transfer gear 32 is non-rotatably coupled to a cam drive gear 34 which meshingly engages a plurality of gear teeth 36 disposed on the cam 12 (see FIG. 3).

Similarly, the low-speed gear assembly 18 includes a low-speed gear train 38 and a low-speed planetary gear set 40. The low-speed gear train 38 is rotatably disposed on posts 37, whereas the low-speed planetary set 40 is rotatably disposed on a post 39. An output gear (not shown) of the low-speed gear train 38 meshingly engages an input gear 44 (see FIG. 2) of the low-speed planetary gear set 40. An output gear 46 (see FIG. 2) of the low-speed planetary gear set 40 meshingly engages the transfer gear 32.

Figures 5A, 5B, 5C:
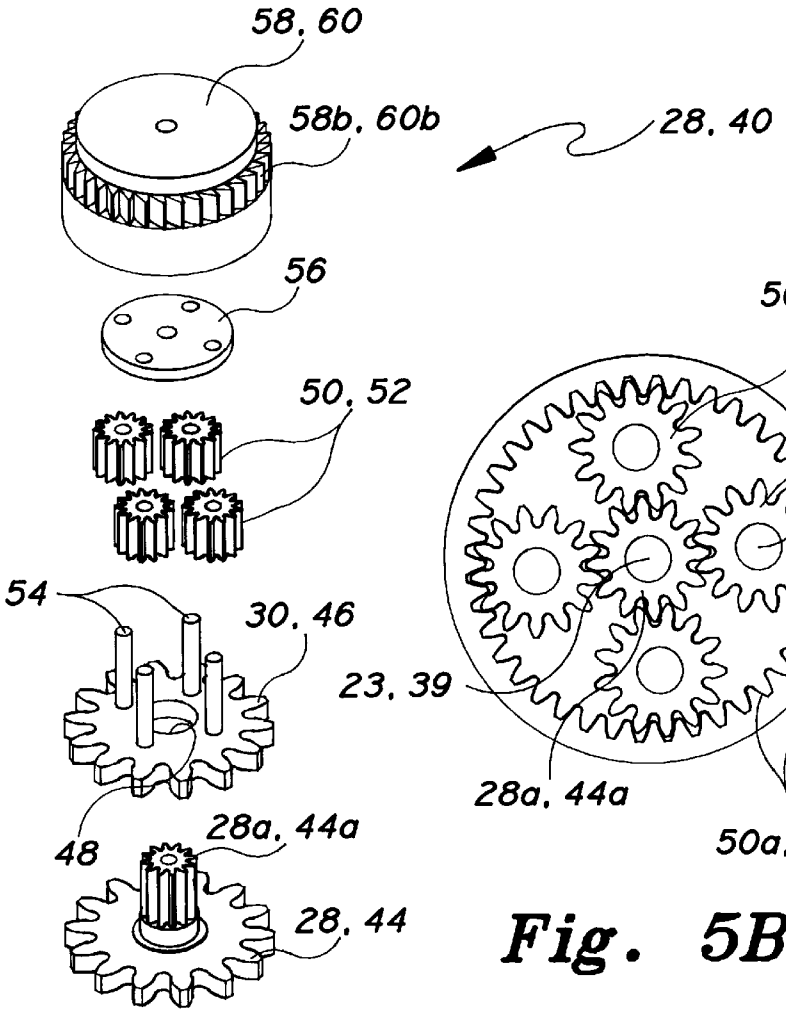
FIG. 5A is an enlarged exploded perspective view of the planetary gear sets of the appliance timer of FIG. 1.
FIG. 5B is a bottom elevational view of the planetary gear sets of FIG. 1.
FIG. 5C is a table showing the magnitude and direction of the respective gears of the planetary gear sets of FIG. 5A.

The high-speed planetary gear set 24 and the low-speed planetary gear set 40 are shown in more detail in FIGS. 5A and 5B. The planetary gear sets 24 and 40 each respectively include a sun gear 28*a* and 44*a* coupled to the input gears 28 and 44, respectively. The sun gears 28*a* and 44*a* are received through an aperture 48 defined in the output gears 30 and 46. Thereafter, the sun gears 28*a* and 44*a* mesh with a number of planetary gears 50 and 52, respectively, which are rotatably disposed on a number of posts 54. The planetary gears 50 and 52 are retained on the posts 54 by a cap 56.

The planetary gears 50 and 52 mesh with a number of gear teeth 58*a* and 60*a* defined in an inner surface of a pair of ring gears 58 and 60, respectively. The ring gears 58 and 60 have a number of ratchet teeth 58*b* and 60*b*, respectively, defined on an outer surface thereof as shown in FIG. 5A. The ratchet teeth 58*b* and 60*b* may be engaged so as to brake or otherwise prevent movement of the ring gears 58 and 60, respectively.

Representative examples of the magnitude and direction of rotation of each of the various gears included in the planetary gear sets 24 and 40 are shown in the table in FIG. 5C. The variables shown in FIG. 5C are as follows: $N_S$=the number of gear teeth defined in the sun gears 28*a*, 44*a*; $N_R$=the number of gear teeth defined in the ring gears 58, 60; and $N_P$=the number gear teeth defined in each of the planetary gears 50, 52. Preferably, the magnitude of the variables shown in FIG. 5C are as follows: $N_S$=12; $N_R$=40; and $N_P$=13.

It should be appreciated that for commonality of parts, the high-speed planetary gear set 24 and the low-speed planetary gear set 40 have identical gear input/output ratios. More specifically, an input rotation speed of equal magnitude on the input gears 28 and 44 will cause an output rotation speed of equal magnitude on the output gears 30 and 46.

However, the gear input/output ratio of the high-speed gear train 22 is greater than the gear input/output ratio of the low-speed gear train 38. Therefore, the output gear 26 of the high-speed gear train 22 will rotate at a faster speed than will the output gear of the low-speed gear train 38. Hence, the input gear 28 of the high-speed planetary gear set 24 will be rotated at a faster speed than the input gear 44 of the low-speed planetary gear set 40 thereby causing the output gear 30 of the high-speed planetary gear set to be rotated at a greater speed than the output gear 46 of the low-speed planetary gear set. Hence, the output gear 30 of the high-speed planetary gear set 24 causes faster rotation of the transfer gear 32, the cam drive gear 34, and the cam 12 than does the output gear 46 of the slow-speed planetary gear set 40.

As shown in FIG. 5C, the output gear 30 will not be energized (i.e. rotated) unless the ring gear 58 is braked, whereas the output gear 46 will not be energized unless the ring gear 60 is braked. Therefore, the transfer gear 32, the cam drive gear 34, and the cam 12 will be rotated at a high speed if the ring gear 58 is braked while ring gear 60 is not braked. It should be noted that if the ring gear 60 is not braked, the low-speed planetary gear set 40 is caused to free spin. What is meant herein by the term "free spin" is that the un-braked ring gear 58 or 60 will rotate at a speed which is dependent upon rotational speed of the transfer gear 32 to which the output gears 30 and 46 are meshingly engaged. Conversely, the transfer gear 32, the cam drive gear 34, and the cam 12 will be rotated at a slow speed if the ring gear 60 is braked while the ring gear 58 is not braked (and therefore caused to free spin).

Rotatably disposed on a post 62 is a pawl 64. The pawl 64 includes a pair of barbs 64*a* and 64*b*. When the pawl 64 is rotated into a first engaged position such that the pawl 64 is moved in a direction toward the ring gear 58, the barb 64*a* is received into one of the ratchet teeth 58*b* thereby preventing the ring gear 58 from rotating relative the post 23. Similarly, when the pawl 64 is rotated into a second engaged position such that the pawl 64 is moved in a direction toward the ring gear 60, the barb 64*b* is received into one of the ratchet teeth 60*b* thereby preventing the ring gear 60 from rotating relative the post 39. Hence, the pawl 64 is used to selectively energize the output gears 30 and 46 of the high-speed planetary gear set 24 and the low-speed planetary gear set 40, respectively.

In order to selectively move an engaging armature 65 included on the pawl 64 toward one of the ring gears 58 and 60, the appliance timer 10 includes a high-speed selector assembly 66 and a low-speed selector assembly 68. The high-speed selector assembly 66 includes a cam reading or follower arm 70 and a directing member 72. On a first end, the cam follower arm 70 includes a stanchion 70*a* which is rotatably received into an aperture 74 defined in a lower housing portion 76. The first end of the cam follower arm 70 also includes a non-rotatable shaft 70*b*. The shaft 70*b* is non-rotatably secured to the directing member 72. The directing member 72 includes a stanchion 72*a* which is rotatably received into an aperture 82 defined in an upper housing portion 84 (see FIG. 2). Hence, the cam follower arm 70 and the directing member 72 rotate relative the lower housing portion 76 and the upper housing portion 84, but do not rotate relative one another.

Similarly, the low-speed selector assembly 68 includes a cam reading or follower arm 86 and a directing member 88. On a first end, the cam follower arm 86 includes a stanchion 86*a* which is rotatably received into an aperture 90 defined in the lower housing portion 76. The first end of the cam follower arm 86 also includes a non-rotatable shaft 86*b*. The shaft 86*b* is non-rotatably secured to the directing member 88. The directing member 88 includes a stanchion 88*a* which is rotatably received into an aperture 94 defined in the upper housing portion 84 (see FIG. 2). Hence, the cam follower arm 86 and the directing member 88 rotate relative the lower housing portion 76 and the upper housing portion 84, but do not rotate relative one another.

Figure 2:
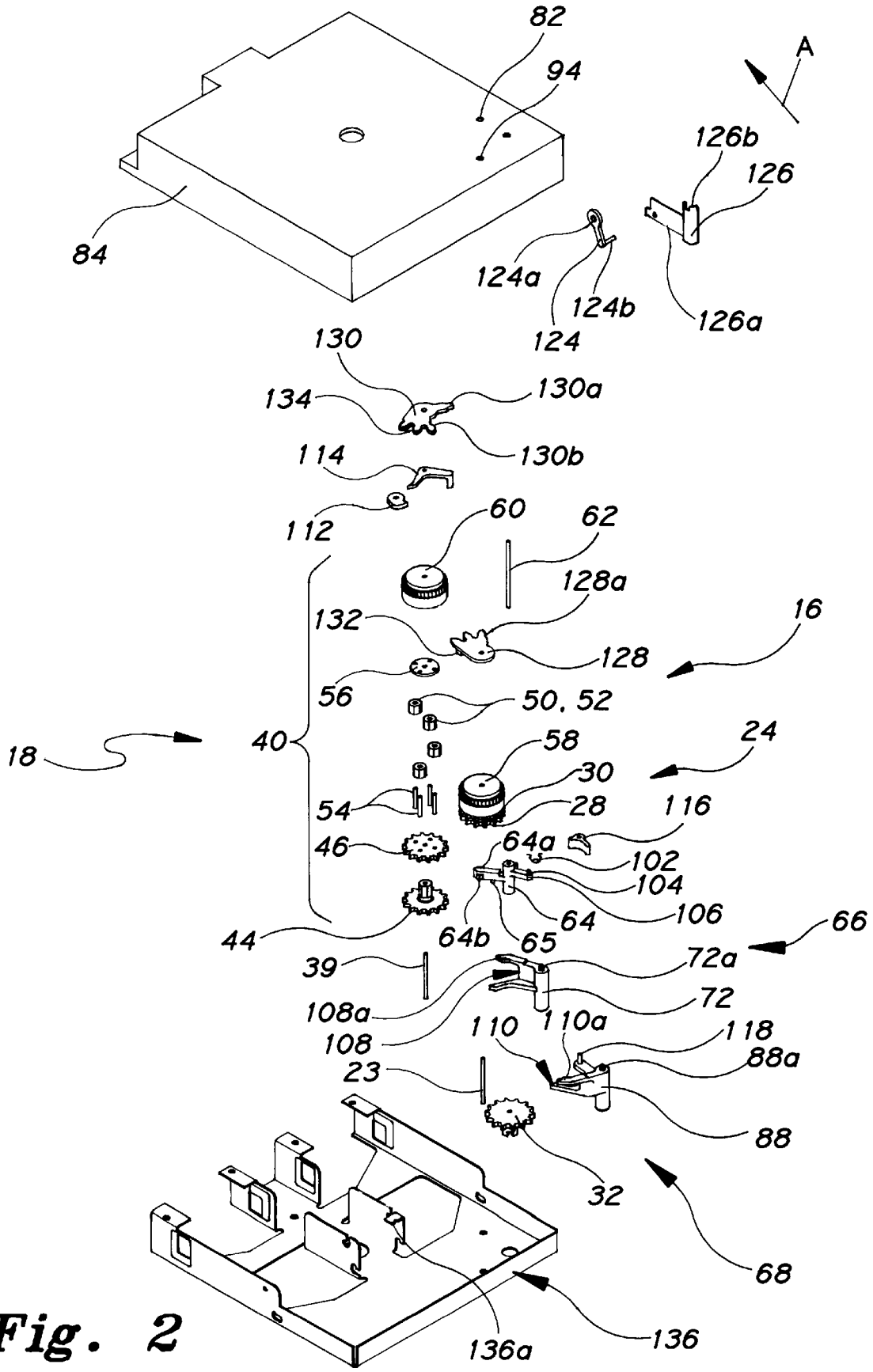
FIG. 2 is an enlarged exploded perspective view of a first portion of the appliance timer of FIG. 1.
Figure 3:
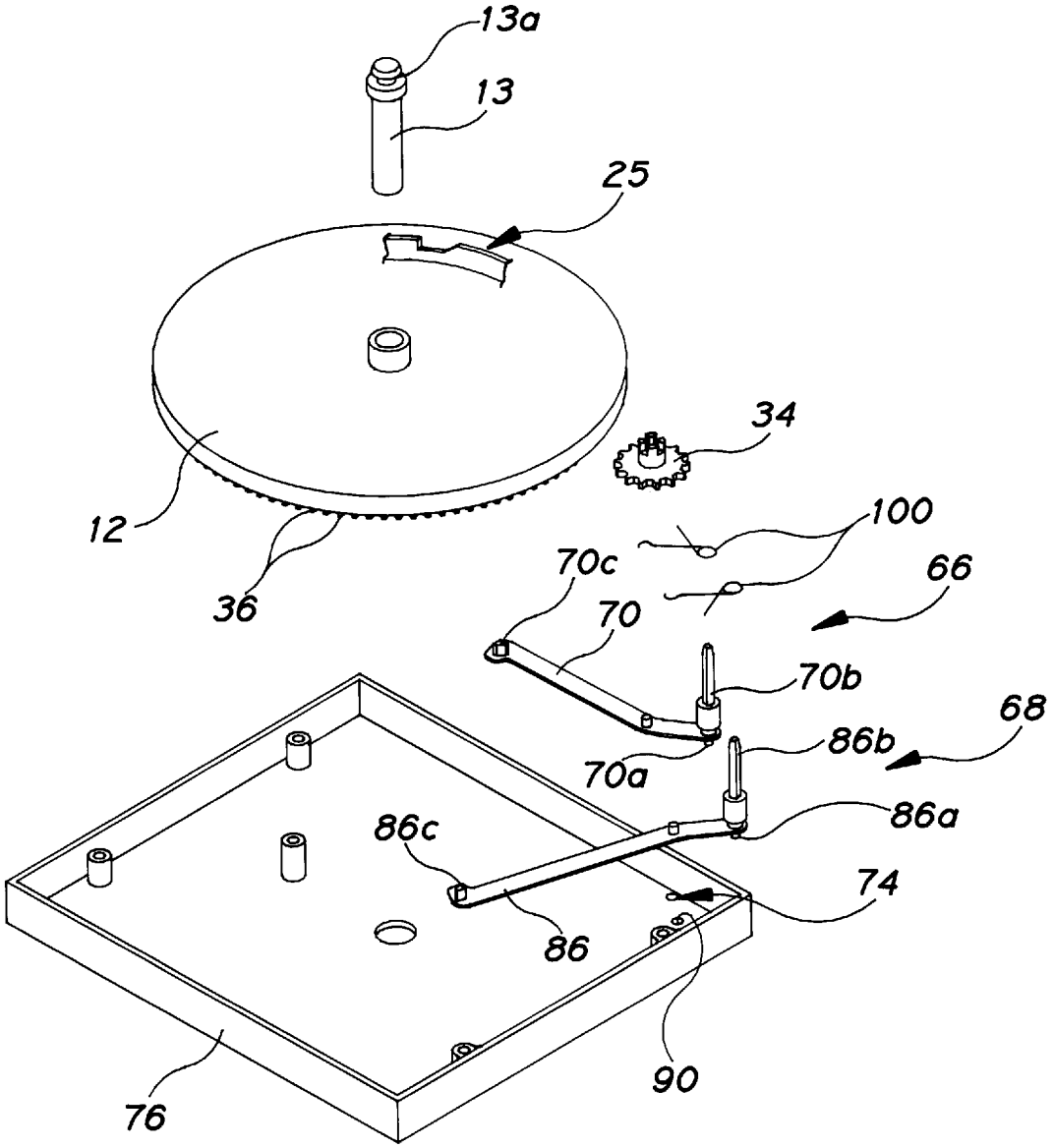
FIG. 3 is an enlarged exploded perspective view of a second portion of the appliance timer of FIG. 1.
Figure 4:
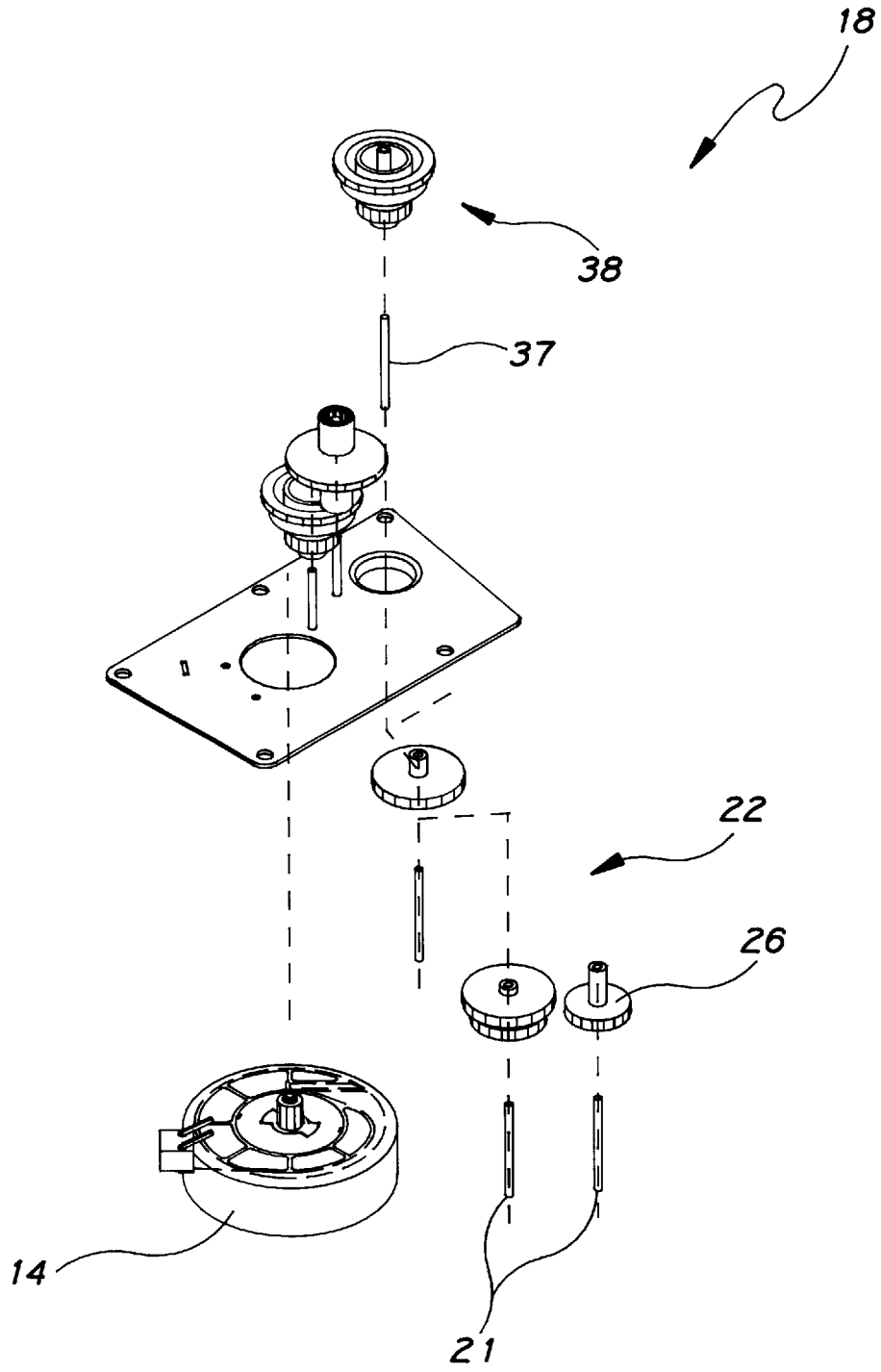
FIG. 4 is an enlarged exploded perspective view of a third portion of the appliance timer of FIG. 1.

An over-center spring 102 is coupled at a first end to the stanchion 72*a* of the directing member 72, and at a second end to a post 104 of an armature 106 included on the pawl 64 (see FIG. 2). The over-center spring 102 generates a bias that retains the pawl 64 in either the first engaged position or the second engaged position wherein the barbs 64*a* and 64*b*, respectively, are engaged with or received into the ratchet teeth 58*b* and 60*b* of the ring gears 58 and 60, respectively. The bias of the over-center spring 102 is overcome when the pawl 64 is rotated past a center point of its path of travel. For example, if the pawl 64 is in its first engaged position and thereafter rotated beyond the center point of its path of travel, the bias of the over-center spring 102 is no longer exerted in a direction so as to retain the pawl 64 in its first engaged position, but rather the bias of the over-center spring 102 is exerted in another direction so as to retain the pawl 64 in its second engaged position.

In order to rotate the pawl 64 in a direction toward the high-speed planetary gear set 24, the directing member 72 includes an armature 108 (see FIG. 2). When the directing member 72 is rotated in a direction toward the pawl 64, the armature 108 contacts the engaging armature 65 of the pawl 64 thereby rotating the pawl 64 in a direction toward the ring gear 58 of the high-speed planetary gear set 24. Once the pawl 64 rotates beyond the center point of its path of travel, the bias of the over-center spring 102 urges the barb 64*a* of the pawl 64 into engagement with the ratchet teeth 58*b* of the ring gear 58 thereby braking the ring gear 58. Once the ring gear 58 is braked, the output gear 30 is caused to rotate at a speed associated with the high-speed gear assembly 16.

Conversely, in order to rotate the pawl 64 in a direction toward the low-speed planetary gear set 40, the directing member 88 includes an armature 110 (see FIG. 2). When the directing member 88 is rotated in a direction toward the pawl 64, the armature 110 contacts the engaging armature 65 of the pawl 64 thereby rotating the pawl 64 in a direction toward the ring gear 60 of the low-speed planetary gear set 40. Once the pawl 64 rotates beyond the center point of its path of travel, the bias of the over-center spring 102 urges the barb 64*b* of the pawl 64 into engagement with the ratchet teeth 60*b* of the ring gear 60 thereby braking the ring gear 60. Once the ring gear 60 is braked, the output gear 46 is caused to rotate at a speed associated with the low-speed gear assembly 18.

Figure 6:
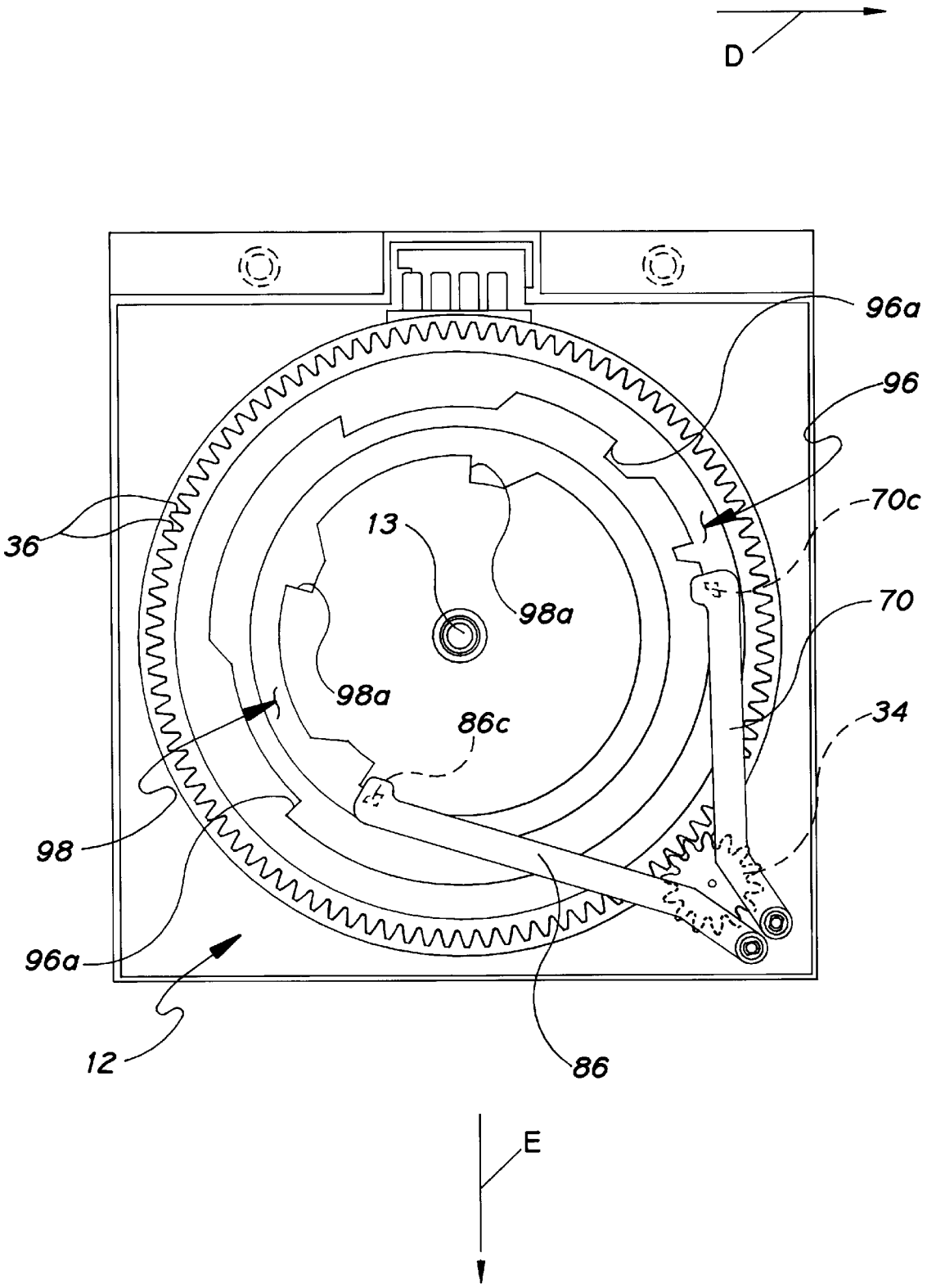
FIG. 6 is a bottom elevational view of the appliance timer of FIG. 1, with the bottom housing portion shown removed for clarity of description.

Referring now to FIG. 6, a second end of each of the cam follower arms 70 and 86 includes a follower member 70*c* and 86*c*, respectively. The follower member 70*c* follows a radial cam profile 96 defined in the bottom of the cam 12. Similarly, the follower member 86*c* follows a radial cam profile 98 defined in the bottom of the cam 12. The cam profiles 96 and 98 have a number of actuation slots 96*a* and 98*a* defined therein. A return spring 100 (see FIG. 3) is coupled to each of the cam follower arms 70 and 86 in order to bias the second end of the cam follower arms 70 and 86 and hence the cam follower members 70*c* and 86*c*, respectively, inwardly toward the control shaft 13. Therefore, the cam follower members 70*c* and 86*c* are biased into the actuation slots 96*a* and 98*a* during rotation of the cam 12.

When the follower member 70*c* drops into one of the actuation slots 96*a*, the directing member 72 is rotated in a direction toward the pawl 64 thereby energizing the output gear 30 of the high-speed planetary set 24, as described above. Hence, the location and size of the actuation slots 96*a* along the cam profile 96 (see FIG. 6) defines a first period of time at which the cam 12 is being rotated at a high speed by the cam drive gear 34.

Similarly, when the follower member 86*c* drops into one of the actuation slot 98*a*, the directing member 88 is rotated in a direction toward the pawl 64 thereby energizing the output gear 46 of the low-speed planetary gear set 40, as described above. Hence, the location and size of the actuation slots 98*a* along the cam profile 98 (see FIG. 6) defines a second period of time at which the cam 12 is being rotated at a low speed by the cam drive gear 34.

Non-rotatably coupled to the low-speed gear train 38 is a pulsing cam 112. The pulsing cam 112 will continue to rotate irrespective of which planetary gear set 24, 40 is engaged by the pawl 64. Rotatably disposed on the post 39 is a pulsing pawl 114. A first end of the pulsing pawl 114 is excited by the pulsing cam 112. A second end of the pulsing pawl 114 contacts a first end of a pulsing lever 116 which is rotatably disposed on a shaft 118 of the director member 88. A second end of the pulsing lever 116 selectively contacts the pawl 64 thereby allowing the barb 64*b* of the pawl to be temporarily urged out of contact with the ratchet teeth 60*b* of the ring gear 60 of the low-speed planetary gear set 40. More specifically, the position of the director member 88 and hence the shaft 118 may be selectively changed by the cam follower member 86 due to the configuration of the actuation slots 98*a* defined in the cam profile 98 such that the second end of the pulsing lever 116 is placed in contact with the pawl 64 in order to move the pawl 64 out of contact with the ratchet teeth 60*b*.

The pulsing lever 116 is configured so as to urge and retain the pawl 64 into a disengaged positioned. More specifically, the pulsing lever 116 urges and retains the pawl 64 away from the ratchet teeth 60*b* during an upward stroke of the pulsing pawl 114. Hence, during the upward stroke of the pulsing pawl 114, the pawl 64 is not engaged with either of the planetary sets 24, 40. The pawl 64 is not urged all the way back to the center point of its path of travel thereby allowing the over-center spring 102 to continue to bias the pawl 64 in a direction toward the ratchet teeth 60*b*. It should be appreciated that when the pawl 64 is not engaged with either of the planetary gear sets 24 and 40, there is no rotation of the transfer gear 32 thereby causing no rotation on the cam 12. However, during a downward stroke of the pulsing pawl 114, the pulsing lever 116 is disengaged from the pawl 64 thereby allowing the bias from the over-center spring 102 to return the barb 64*b* of the pawl 64 into contact with the ratchet teeth 60*b* thereby creating output rotation on the output gear 46 of the low-speed planetary gear set 40, which in turn rotates the cam 12.

Hence, it should therefore be appreciated that the cam profiles 96 and 98 function so as to change the speed at which the cam 12 is rotating. In other words, cam data defined in the cam surfaces on the bottom of the cam 12 causes changes in rotational speed of the cam 12 itself. The cam may be rotated at a high speed, a slow speed, or an interrupted slow speed (i.e. not continuously rotating). The use of multiple speeds allows the cam 12 to be quickly rotated during numerous short time intervals thereby improving the accuracy at which the appliance timer 10 controls a number of critical appliance work operations, while also slowing the cam 12 during time intervals that the appliance timer 10 controls a number of non-critical appliance work operations thereby conserving cam space.

Figure 7:
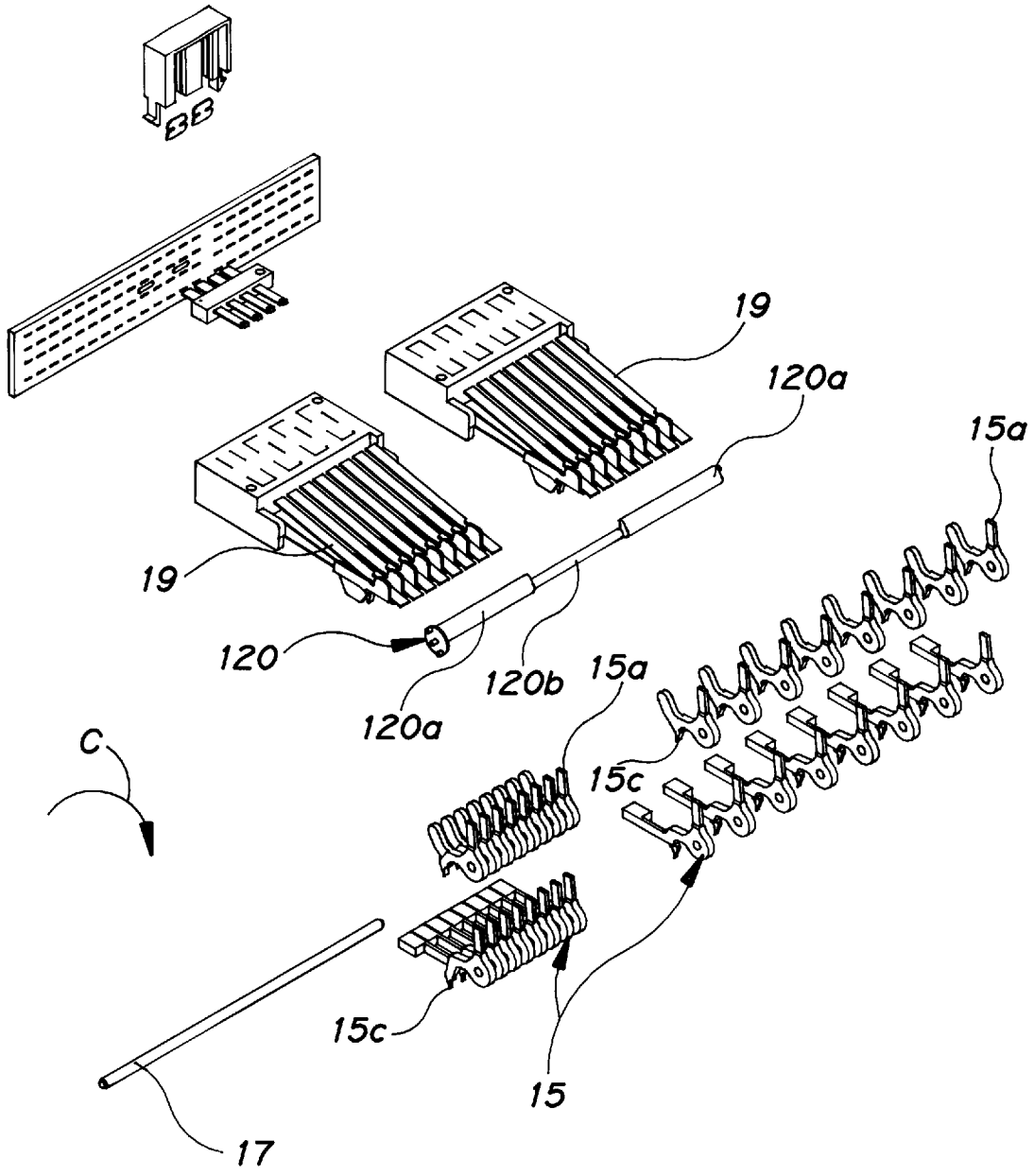
FIG. 7 is an enlarged exploded view of a fourth portion of the appliance timer of FIG. 1.
Figure 8:
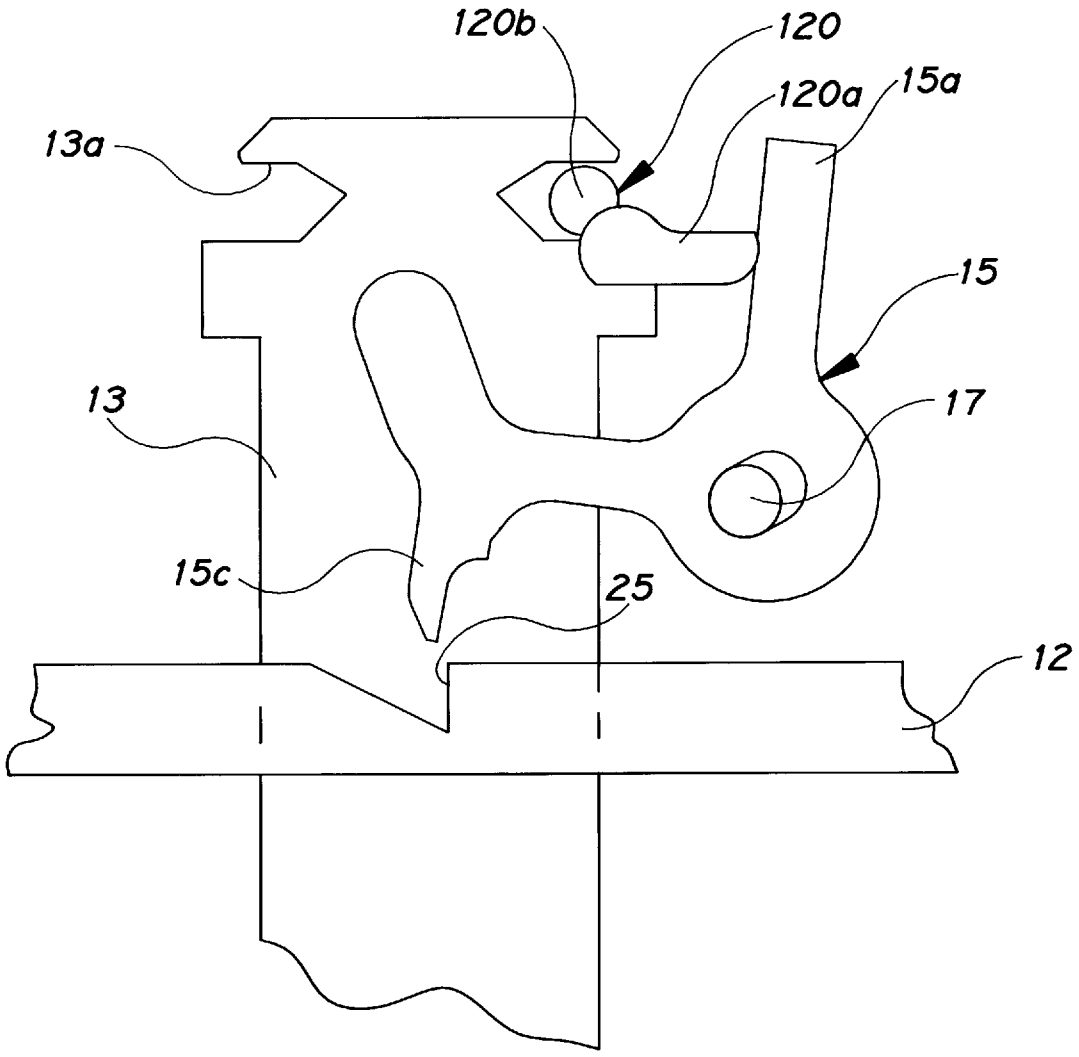
FIG. 8 is an enlarged elevational view showing the control shaft of the appliance timer of FIG. 1 positioned in a first position.

In order to allow the appliance timer 10 to be manually set or otherwise positioned by the operator of the appliance, the appliance timer 10 includes an intermediate member 120, an over-center spring 122, a lever 124, a sliding member 126, and a pair of sector gears 128 and 130 as shown in FIGS. 1–2, and 7–10. An eccentric central section 120*b* of the intermediate member 120 is received into a receiving notch 13*a* (see FIG. 3) defined in the control shaft 13 thereby connecting the intermediate member 120 to a first end of the control shaft 13, whereas a knob (not shown) is coupled to a second end of the control shaft 13. If an operator of the appliance pushes the knob, the control shaft 13 will be urged in the general direction of arrow B of FIG. 1 thereby positioning the control shaft 13 in a first position as shown in FIG. 8. When the control shaft 13 is positioned in its first position, the intermediate member 120 is positioned in a lift position in which the intermediate member 120 prevents the rocker arms 15 from contacting the cam profiles 25 on the top of the cam 12. More specifically, as shown in FIG. 7, each of the rocker arms 15 includes a disengagement tab 15*a* which is contacted by a number of contact lobes 120*a* defined in the outer sections of the intermediate member 120. As the control shaft 13 is urged in the general direction of arrow B of FIG. 1, the intermediate member 120 is rotated in the general direction of arrow C of FIG. 7 thereby urging the contact lobes 120*a* into contact with the disengagement tabs 15*a*. Such contact of the disengagement tabs 15*a* causes the rocker arms 15 to rotate relative to the rocker arm shaft 17 (in the general direction of arrow C of FIG. 7) thereby placing the rocker arms in an idle mode of operation in which the cam followers 15*c* are spaced apart from the cam profiles 25.

Moreover, a first end of the intermediate member 120 is received into an aperture 124*a* defined in the lever 124 (see FIG. 2). A post 124*b* included on the lever 124 is received into an aperture 126*a* defined in a first end of the sliding member 126 (see FIG. 2). Rotation of the intermediate member 120, such as when the operator pushes the knob, urges the lever 124 and hence the sliding member 126 in the general direction of arrow A in FIG. 2.

The sector gear 128 is rotatably disposed on the post 23, whereas the sector gear 130 is rotatably disposed on the post 39. The sector gear 128 meshingly engages the sector gear 130. In addition, a tab 130*a* of the sector gear 130 is received into a slot 126*b* defined in the second end of the sliding member 126 (see FIG. 2) thereby causing the sector gears 128 and 130 to rotate when the operator pushes the knob. The sector gear 128 includes a contact edge 128*a* (see FIG. 10) which, upon rotation of the sector gear 128, urges an upper branch 108*a* (see FIG. 10) of the armature 108 of the directing member 72 in the general direction of arrow F of FIG. 10 such that the cam follower arm 70 is urged in the general direction of arrow D of FIG. 6 and into an idle mode of operation in which the cam follower 70*c* is spaced apart from the cam profile 96. Similarly, the sector gear 130 includes a contact edge 130*b* (see FIG. 10) which, upon rotation of the sector gear 130, urges an upper branch 110*a* (see FIG. 10) of the armature 110 of the directing member 88 in the general direction of arrow G of FIG. 10 such that the cam follower arm 86 is urged in the general direction of arrow E of FIG. 6 and into an idle mode of operation in which the cam follower 86*c* is spaced apart from the cam profile 98.

Figure 10:
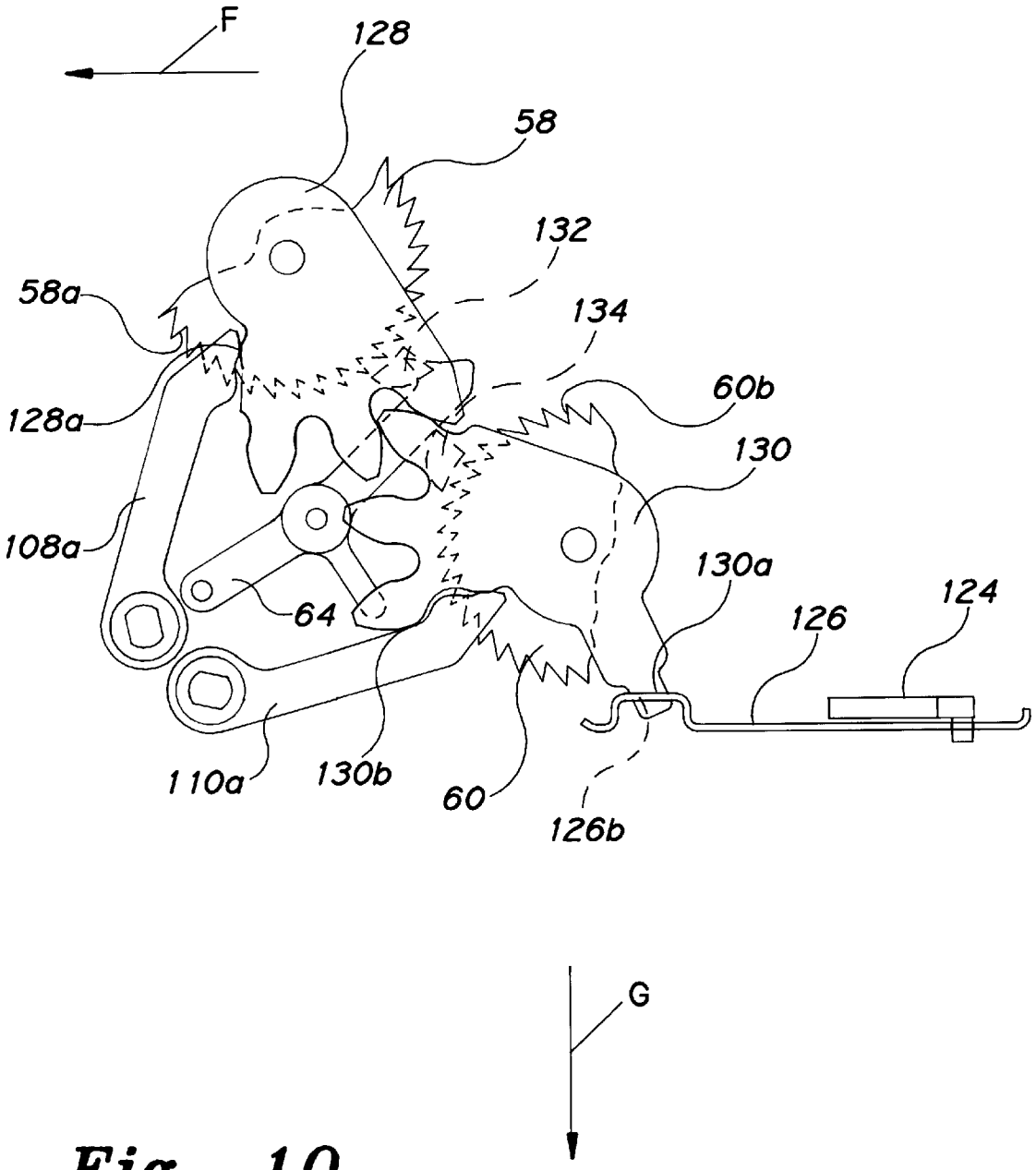
FIG. 10 is an enlarged top elevational view showing the sector gears positioned in contact with the upper branches of the directing members of the appliance timer of FIG. 1 (Note: a number of the components associated with the appliance timer have been removed for clarity of description)

In addition, the sector gear 128 includes a beveled surface member 132, whereas the sector gear 130 includes a beveled surface member 134 (see FIG. 10). Upon rotation of the sector gears 128 and 130, the beveled surface members 132 and 134 are positioned such that the pawl 64 is sandwiched therebetween thereby positioning the pawl 64 in its disengaged position. More specifically, the beveled surface members 132 and 134 cooperate to position the pawl 64 such that the pawl 64 is disengaged from both the ring gear 58 of the high-speed planetary gear set 24 and the ring gear 60 of the low-speed planetary gear set 40 (see FIG. 10).

Figure 9:
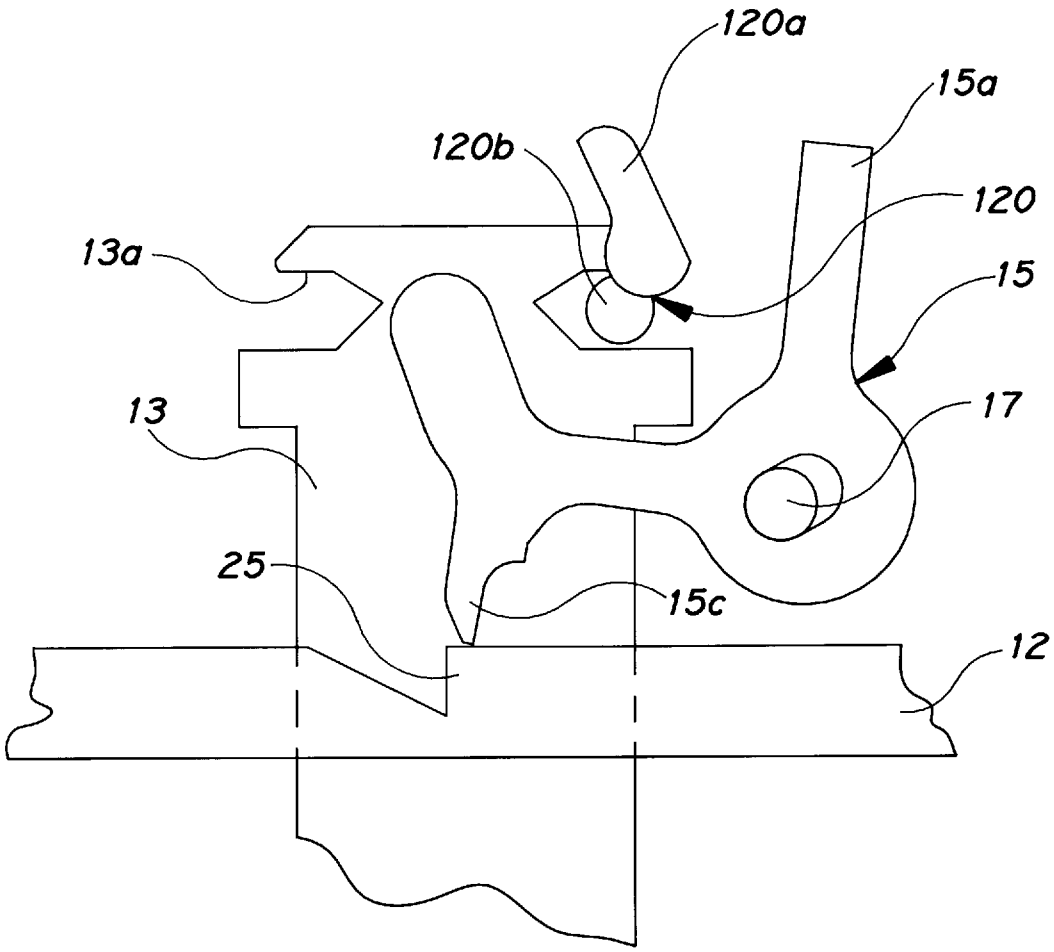
FIG. 9 is a view similar to FIG. 8, but showing the control shaft positioned in a second position.

Conversely, when the operator pulls the knob, the control shaft 13 is urged into a second position as shown in FIG. 9. When the control shaft 13 is positioned in its second position, the intermediate member 120 is rotated back into a release position in which the contact lobes 120*a* are spaced apart from the disengagement tabs 15*a*. When the intermediate member 120 is positioned in its release position, the rocker arms 15 are positioned in a cam reading mode of operation in which the cam followers 15*c* are urged back into contact with the cam profiles 25 on the top of the cam 12. In addition, the cam follower arms 70 and 86 are positioned in a cam reading mode of operation in which the cam followers 70*c* and 86*c* are urged back into contact with the cam profiles 96 and 98, respectively.

Figure 11:
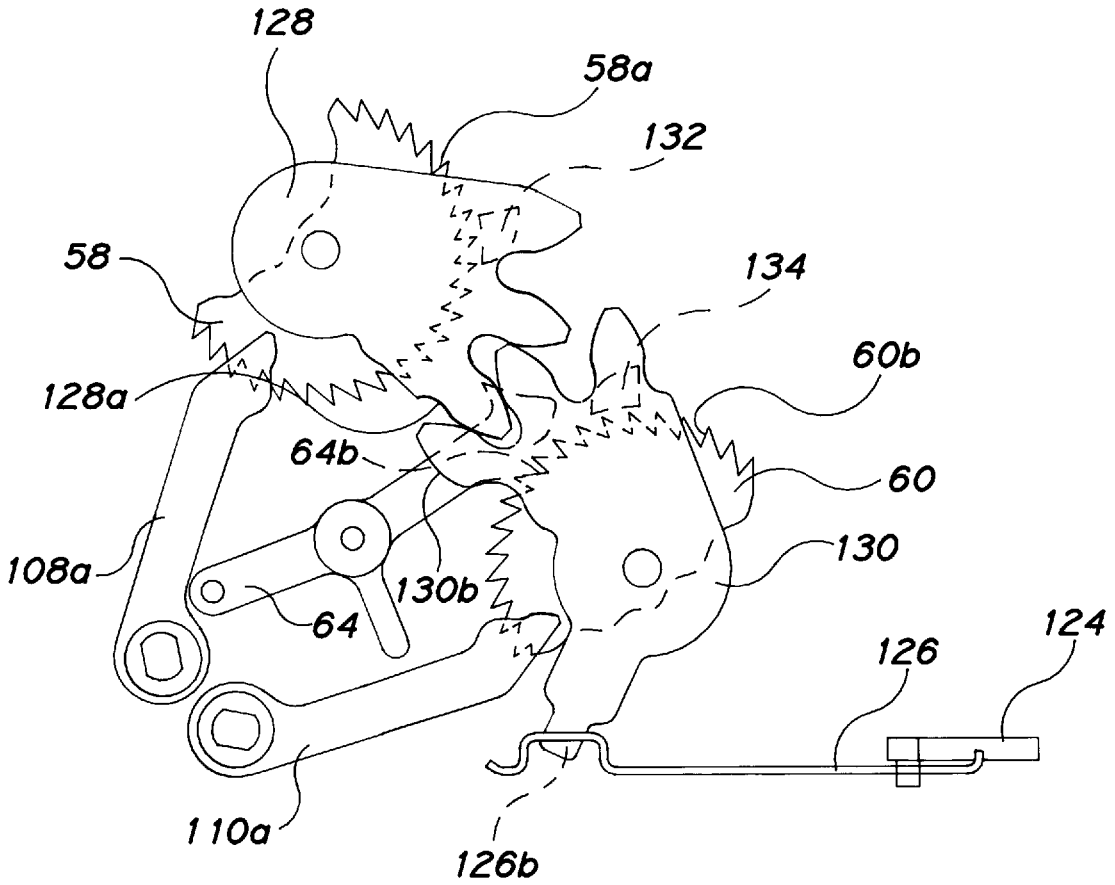
FIG. 11 is a view similar to FIG. 10, but showing the sector gears spaced apart from the upper branches of the directing members (Note: a number of the components associated with the appliance timer have been removed for clarity of description).

Moreover, when the operator pulls the knob thereby positioning the control shaft 13 in its second position, the sector gears 128 and 130 are rotated back to their original position thereby causing the beveled surface members 132 and 134 to be spaced apart from the pawl 64. When the beveled surface members 132 and 134 are spaced apart from the pawl 64, the pawl 64 is positionable in either its first engaged position or its second engaged position. For example, when the beveled surface members 132 and 134 are spaced apart from the pawl 64, the pawl 64 may be positioned in its second engaged position in which the barb 64*b* of the pawl 64 is engaged with one of the ratchet teeth 60*b* of the ring gear 60 (see FIG. 11).

The over-center spring 122 is coupled at a first end to the central section 120*b* of the intermediate member 120, and at a second end to a flange 136*a* defined in a housing portion 136 (see FIG. 2). The over-center spring 122 generates a bias that retains the intermediate member 120 in either the lift position (see FIG. 8) or the release position (see FIG. 9). The bias of the over-center spring 122 is overcome when the control shaft 13 is switched between its first and second position, or vice versa. For example, if the control shaft 13 is positioned in its first position (see FIG. 8) and thereafter the operator pulls the knob, the bias of the over-center spring 122 is no longer exerted in a direction so as to retain the intermediate member 120 in its lift position, but rather the bias of the over-center spring 122 is exerted in another direction so as to retain the intermediate member 120 in its release position.

As described above, the appliance timer 10 includes a rotating cam 12 which can selectively change speeds so as to rotate at a high speed when actuating and deactuating switches within the appliance timer so that improved timing accuracy of particular (i.e. critical) work operations is achieved, and yet rotate the cam at a low speed when the appliance timer is actuating or deactuating switches associated with other (i.e. non-critical) work operations so that space on the surface of the cam is conserved. Such an appliance timer design creates numerous advantages over other appliance timers which have heretofore been developed.

While the invention has been illustrated and described in detail in the drawings and foregoing description, such illustration and description is to be considered as exemplary and not restrictive in character, it being understood that only the preferred embodiment has been shown and described and that all changes and modifications that come within the spirit of the invention are desired to be protected.

For example, although the cam 12 is described as a single, horizontally disposed cam, other cam configurations could also be used. For example, the cam 12 could be multiple cylindrical cams (e.g. a camstack) with separate cam profiles functioning as the cam profiles 25, 96, and 98.

What is claimed is:

1. An apparatus for permitting quiet manual setting of an appliance timer, with said appliance timer including an appliance control cam having a plurality of cam profiles and a plurality of gear teeth defined therein, comprising:

a cam reading arm positionable between a cam reading mode of operation and an idle mode of operation, wherein (1) said cam reading arm contacts said cam profiles when said cam reading arm is positioned in said cam reading mode of operation, and (2) said cam reading arm is spaced apart from said cam profiles when said cam reading arm is positioned in said idle mode of operation;

a control shaft positionable between a first position and a second position; and an intermediate member, wherein (1) said control shaft locates said intermediate member so as to cause said intermediate member to position said cam reading arm in said idle mode of operation when said control shaft is positioned in said first position, and (2) said control shaft locates said intermediate member so as to cause said intermediate member to position said cam reading arm in said cam reading mode of operation when said control shaft is positioned in said second position.

2. The apparatus of claim 1, wherein:

said cam reading arm includes a cam follower, said cam follower contacts said cam profiles when said cam reading arm is positioned in said cam reading mode of operation, and said cam follower is spaced apart from said cam profiles when said cam reading arm is positioned in said idle mode of operation.

3. The apparatus of claim 2, wherein:

said intermediate member has a contact lobe defined therein, said cam reading arm includes a disengagement tab, and said contact lobe of said intermediate member biases said disengagement tab so as to position said cam reading arm in said idle mode of operation when said control shaft is positioned in said first position.

4. The apparatus of claim 3, wherein:

said control shaft has a receiving notch defined therein, said intermediate member includes a first section and a second section, said first section of said intermediate member is positionable in said receiving notch of said control shaft, and said second section of said intermediate member includes said contact lobe.

5. The apparatus of claim 4, wherein:

said intermediate member includes a shaft, and said first section of said intermediate member is eccentrically positioned relative to said second section of said intermediate member.

6. The apparatus of claim 3, wherein:

said intermediate member is positioned in a lift position when said control shaft is positioned in said first position, said intermediate member is positioned in a release position when said control shaft is positioned in said second position, said contact lobe of said intermediate member is positioned in contact with said disengagement tab of said cam reading arm when said intermediate member is positioned in said lift position, and said contact lobe of said intermediate member is spaced apart from said disengagement tab of said cam reading arm when said intermediate member is positioned is said release position.

7. The apparatus of claim 6, further comprising an over center spring, wherein:

said over center spring urges said intermediate member into said lift position when said control shaft is positioned in said first position, and said over center spring urges said intermediate member into said release position when said control shaft is positioned in said second position.

8. The apparatus of claim 1, further comprising:

a sector gear operatively coupled to said intermediate member, said sector gear having a contact edge defined therein; and a directing member secured to said cam reading arm, wherein said sector gear is rotated such that said contact edge contacts said directing member when said control shaft is positioned in said first position so as to position said cam reading arm in said idle mode of operation.

9. The apparatus of claim 8, further comprising a sliding member, wherein:

said sliding member is operatively coupled to said intermediate member, said sliding member is operatively coupled to said sector gear, and said control shaft locates said intermediate member so as to cause said sliding member to rotate said sector gear when said control shaft is positioned in said first position.

10. The apparatus of claim 9, further comprising a lever, wherein:

said lever is operatively coupled to said intermediate member, said lever has a post secured thereto, said sliding member has an aperture defined therein, and said post is received into said aperture so as to mechanically couple said intermediate member to said sliding member.

11. The apparatus of claim 9, wherein:

said sliding member has a slot defined therein, said sector gear has a tab secured thereto, and said tab is secured within said slot so as to mechanically couple said sector gear to said sliding member.

12. The apparatus of claim 1, further comprising a pawl which is positionable between an engaged position and a disengaged position, wherein:

said pawl is engaged with a gear assembly of said appliance timer when said pawl is positioned in said engaged position, said pawl is disengaged with said gear assembly of said appliance timer when said pawl is positioned in said disengaged position, said control shaft locates said intermediate member so as to cause said intermediate member to position said pawl in said disengaged position when said control shaft is positioned in said first position, and said control shaft locates said intermediate member so as to cause said intermediate member to position said pawl in said engaged position when said control shaft is positioned in said second position.

13. The apparatus of claim 12, further including:

a sector gear having a beveled surface member, and said beveled surface member of said sector gear contacts said pawl so as to position said pawl in said disengaged positioned when said control shaft is positioned in said first position.

14. An apparatus for permitting quiet manual setting of an appliance timer, with said appliance timer including an appliance control cam having a first cam surface defined on a first side thereof and a second cam surface defined on a second side thereof, comprising:

a rocker arm positionable between a first cam reading mode of operation and a first idle mode of operation, wherein (1) said rocker arm contacts said first cam surface when said rocker arm is positioned in said first cam reading mode of operation, and (2) said rocker arm is spaced apart from said first cam surface when said rocker arm is positioned in said first idle mode of operation;

a cam follower arm positionable between a second cam reading mode of operation and a second idle mode of operation, wherein (1) said cam follower arm contacts said second cam surface when said cam follower arm is positioned in said second cam reading mode of operation, and (2) said cam follower arm is spaced apart from said second cam surface when said cam follower arm is positioned in said second idle mode of operation;

a control shaft positionable between a first position and a second position; and an intermediate member, wherein said control shaft locates said intermediate member so as to cause said intermediate member to position (1) said rocker arm in said first idle mode of operation, and said cam follower arm in said second idle mode of operation when said control shaft is positioned in said first position, and (2) said rocker arm in said first cam reading mode of operation, and said cam follower arm in said second cam reading mode of operation when said control shaft is positioned in said second position.

15. The apparatus of claim 14, wherein:

said intermediate member has a contact lobe defined therein, said rocker arm includes a disengagement tab, said contact lobe of said intermediate member biases said disengagement tab so as to position said rocker arm in said first idle mode of operation when said control shaft is positioned in said first position.

16. The apparatus of claim 14, further comprising:

a sector gear operatively coupled to said intermediate member, said sector gear having a contact edge defined therein; and a directing member secured to said cam follower member, wherein said sector gear is rotated such that said contact edge contacts said directing member when said control shaft is positioned in said first position so as to position said cam follower member in said second idle mode of operation.

17. The apparatus of claim 16, further comprising a sliding member, wherein:

said sliding member is operatively coupled to said intermediate member, said sliding member is operatively coupled to said sector gear, and said control shaft locates said intermediate member so as to cause said sliding member to rotate said sector gear when said control shaft is positioned in said first position.

18. The apparatus of claim 17, further comprising a lever, wherein:

said lever is operatively coupled to said intermediate member, said lever has a post secured thereto, said sliding member has an aperture defined therein, and said post is received into said aperture so as to mechanically couple said intermediate member to said sliding member.

19. The apparatus of claim 14, further comprising a pawl which is positionable between an engaged position and a disengaged position, wherein:

said pawl is engaged with a gear assembly of said appliance timer when said pawl is positioned in said engaged position, said pawl is disengaged with said gear assembly of said appliance timer when said pawl is positioned in said disengaged position, said control shaft locates said intermediate member so as to cause said intermediate member to position said pawl in said disengaged position when said control shaft is positioned in said first position, and said control shaft locates said intermediate member so as to cause said intermediate member to position said pawl in said engaged position when said control shaft is positioned in said second position.

20. The apparatus of claim 19, further including:

a sector gear having a beveled surface member, and said beveled surface member of said sector gear contacts said pawl so as to position said pawl in said disengaged positioned when said control shaft is positioned in said first position.

* * * * *